US009517390B1

(12) United States Patent
Duffy

(10) Patent No.: US 9,517,390 B1
(45) Date of Patent: Dec. 13, 2016

(54) HOCKEY PUCK LOCKER

(71) Applicant: Michael E. Duffy, Plattsmouth, NE (US)

(72) Inventor: Michael E. Duffy, Plattsmouth, NE (US)

( * ) Notice: Subject to any disclaimer, the term of this patent is extended or adjusted under 35 U.S.C. 154(b) by 15 days.

(21) Appl. No.: 14/298,260

(22) Filed: Jun. 6, 2014

(51) Int. Cl.
*A63B 69/00* (2006.01)
*A63B 47/00* (2006.01)

(52) U.S. Cl.
CPC ..... *A63B 47/002* (2013.01); *A63B 69/0026* (2013.01)

(58) Field of Classification Search
CPC ..... A63B 63/00; A63B 79/0026
See application file for complete search history.

(56) References Cited

U.S. PATENT DOCUMENTS 4,575,719 A * 3/1986 Bertagna ..... G07F 17/12 235/381
5,282,628 A * 2/1994 Komori ..... A63B 47/002 473/136
5,667,222 A * 9/1997 Bunyi ..... A63B 57/0006 473/134
5,846,144 A * 12/1998 Bothers ..... A63B 47/002 473/446
7,213,722 B2 * 5/2007 Nagelski ..... A47F 1/087 221/246

* cited by examiner

*Primary Examiner* — Timothy Waggoner
*Assistant Examiner* — Ayodeji Ojofeitimi
(74) *Attorney, Agent, or Firm* — Dennis L. Thomte; Thomte Patent Law Office LLC

(57) ABSTRACT

A practice hockey puck locker which is mounted on an upstanding wall member. The locker includes a first upstanding first rectangular tube, having open upper and lower ends, a second tubular member, having upper and lower ends, extending downwardly from the lower end of the first tubular member and a third tubular member, having upper and lower ends, extending downwardly from the lower end of the third tubular member. A puck dispenser housing is secured to the lower end of the third tubular member. A key operated dead bolt is positioned on the dispenser housing which is selectively movable between locked and unlocked positions. When the dead bolt is in the locked position, the pucks cannot be dispensed from the dispenser housing. When the dead bolt is in the unlocked position, the pucks may fall from the lower end of the discharge dispenser.

2 Claims, 5 Drawing Sheets

HOCKEY PUCK LOCKER

BACKGROUND OF THE INVENTION

Field of the Invention

This invention relates to a hockey puck locker and more particularly to a locker wherein practice hockey pucks may be stored and dispensed as needed for practice.

Description of the Related Art

As is well known, many hockey teams especially juniors, intermediates, and advanced hockey teams, carry their practice hockey pucks to practice sessions in a pail or bucket. When the practice session ends, the practice pucks are gathered and placed in the pail or bucket which was used to bring the pucks to the practice session. The pail or bucket with the practice pucks therein is then carried to a vehicle and left therein until the next practice session.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A practice hockey puck locker is provided which is mounted on an upstanding wall member of a hockey rink or the like. The locker includes a vertically disposed first rectangular tubular member having an open upper end and an open lower end. The open upper end of the first rectangular tubular member is configured to receive hockey pucks therein in a vertically disposed manner. The locker also includes a second rectangular tubular member having on open upper end and an open lower end. The open upper end of the second rectangular member is in communication with the open lower end of the first rectangular tubular member. The second rectangular tubular member extends downwardly and outwardly from the open lower end of the first rectangular tubular member in the same vertical plane thereof.

The locker also includes a third rectangular tubular member having an open upper end and an open lower end. The upper end of the third rectangular tubular member is in communication with the lower end of the second rectangular tubular member. The third rectangular tubular member extends downwardly from the lower end of the second tubular member at an angle which is approximately 45 degrees.

A discharge housing is provided including an open intake end and an open discharge end. The open intake end of the discharge housing is in communication with the open lower end of the third rectangular tubular member. The open lower end of the discharge housing is configured to be in selective communication with a puck container.

A key operated dead bolt lock is mounted in the discharge housing and includes a slidable dead bolt which is movable between locked and unlocked positions. The slidable dead bolt, when in its locked position, prevents the passage of pucks from the open lower end of the discharge housing. The slidable dead bolt, when in its unlocked position, permits the passage of pucks from the open lower end of the discharge housing into a pail or bucket.

It is therefore a principal object of the invention to provide a practice hockey puck locker for mounting on an upstanding wall member.

A further object of the invention is to provide a device of the type described which enables practice pucks to be stored therein which eliminates the need for hockey pucks to be brought to the practice arena and to be then carried from the practice arena.

A further object of the invention is to provide a device of the type described which eliminates the need for a large number of practice hockey pucks to be brought to a practice arena which is used by several hockey teams.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
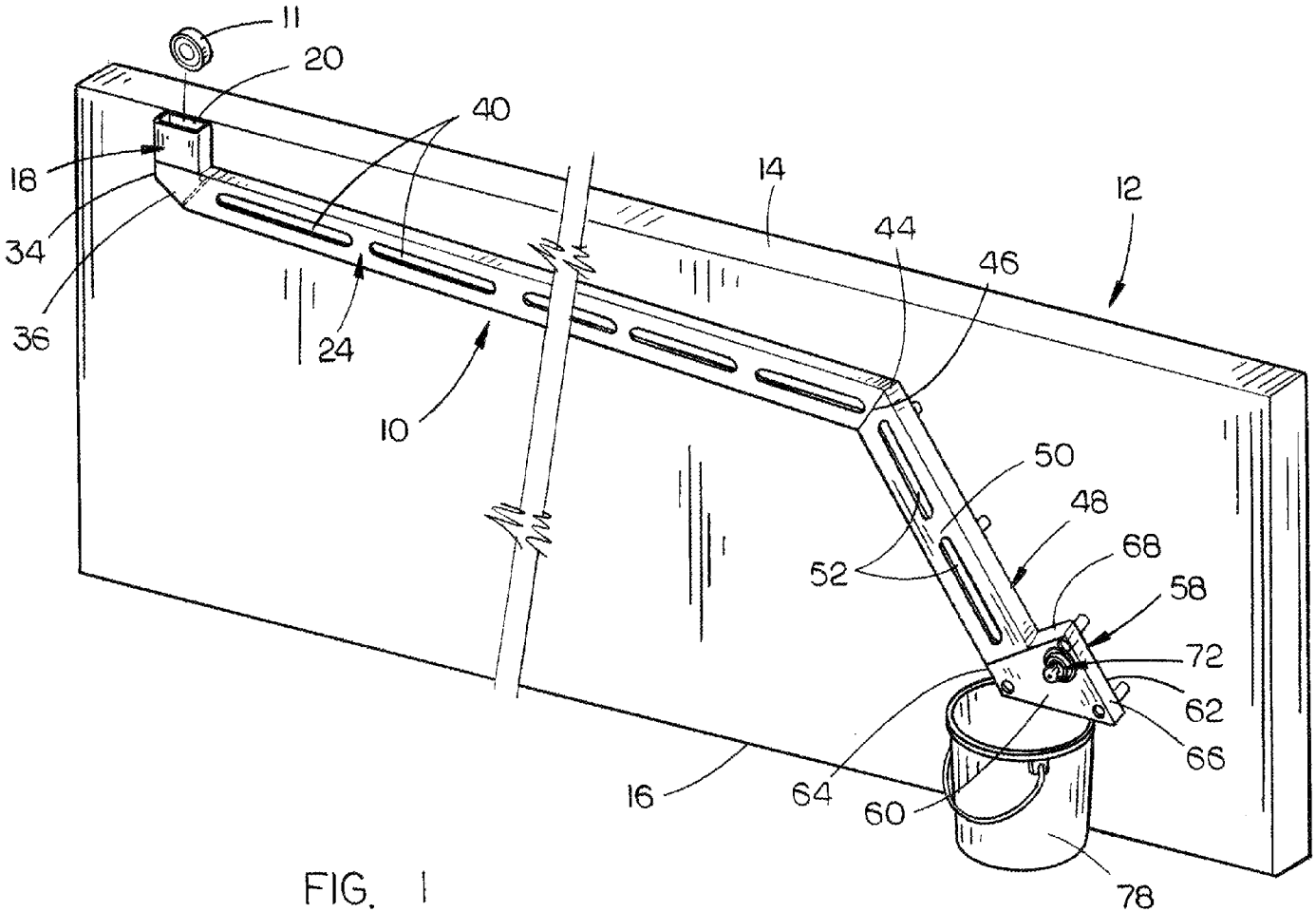
FIG. 1 is a partial perspective view illustrating the hockey puck locker of this invention mounted on a wall such as a hockey rink wall.

The hockey puck locker of this invention is designated by the reference numeral 10 and is designed to store and dispense practice hockey pucks 11. Locker 10 is designed to be mounted on a wall but it is preferred that the locker 10 be mounted on the outer side of a hockey rink wall 12, having an upper end 14 and a lower end 16. Locker 10 includes a vertically disposed puck inlet tube 18 which has a height of two to three inches. Tube 18 is formed from rectangular steel tubing which preferably has an inside diameter of one and one-quarter inches by three and three-quarter inches. Tube 18 will be described as having an open upper end 20 and an open lower end 22. The numeral 24 refers to a rectangular steel tube which is welded to the lower end 22 of tube 18 and which extends downwardly from tube 18 at approximately a 12-degree angle with respect thereto. Tube 24 has an upper wall 26, lower wall 28, inner wall 30 and outer wall 32. The upper end of upper wall 26 has an opening formed therein which communicates with the open lower end 22 of tube 18. The upper end of tube 24 is closed by a straight wall section 34 and an inclined wall section 36. The lower wall 28 of tube 24 has a plurality of longitudinally extending and spaced-apart slots 38 formed therein. The outer wall 32 of tube 24 has a plurality of longitudinally extending and spaced-apart slots 40 formed therein. Tube 24 has the same dimensions as tube 18. As seen in FIG. 1, the lower end 44 of tube 24 is tapered.

Figure 5:
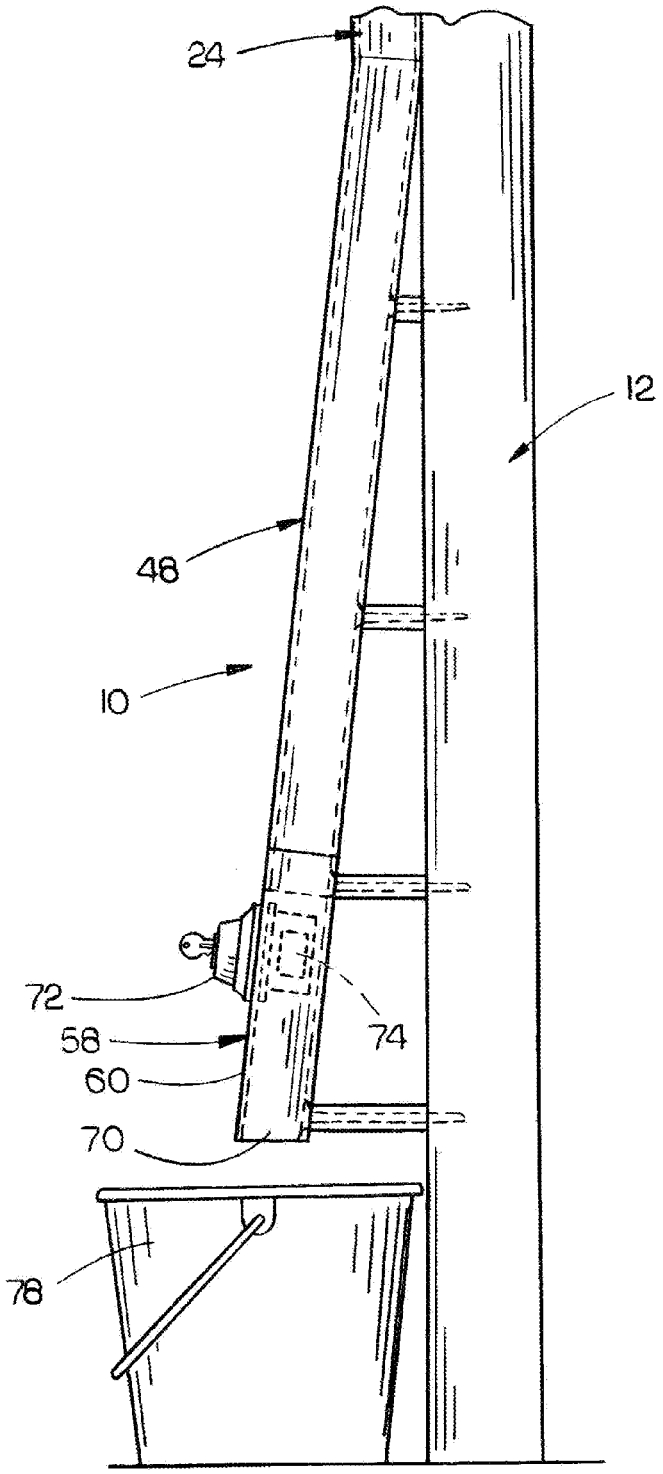
FIG. 5 is an end elevational view of the lower portion of the locker of this invention.

The tapered upper end 46 of a rectangular steel tube 48 is welded to the tapered lower end 44 of tube 24. Tube 48 extends downwardly from tube 24 at a 45-degree angle with respect to the longitudinal axis of tube 24. Preferably, the tube 48 also extends outwardly with respect to the plane of tube 24, as seen in FIG. 5, for a reason to be explained hereinafter. Tube 24 has a length of approximately seven feet but that length may be extended or reduced depending upon the number of hockey pucks 11 to be stored within the locker 10. The outer wall 50 of tube 48 has one or more elongated slots 52 formed therein. The lower wall 54 of tube 48 has an elongated slot formed therein such as the slots 38.

The numeral 58 refers to a locker housing which is welded to the lower end of tube 48, as seen in the drawings. Housing 58 includes an outer wall 60, an inner wall 62, a back wall 64, a front wall 66 and an upper wall 68. The walls 60, 62, 64, 66 and 68 are welded together to form the housing 58 which has an open lower end 70 which has a rectangular configuration. A key operated dead bolt lock 72 of conventional design is mounted on outer wall 60 of housing 58 and has a movable dead bolt 74 positioned in the interior of housing 58. When the dead bolt lock 72 is in the unlocked or retracted position, the pucks 11 moving downwardly from tube 48 into housing 58 will freely pass through the housing 58 and downwardly from the open lower end 70 of housing 58. When the dead bolt lock 72 is in the locked position, the dead bolt 74 will be in the path of the lowermost puck 11 to prevent the passage of pucks from the housing 58.

Figure 2:
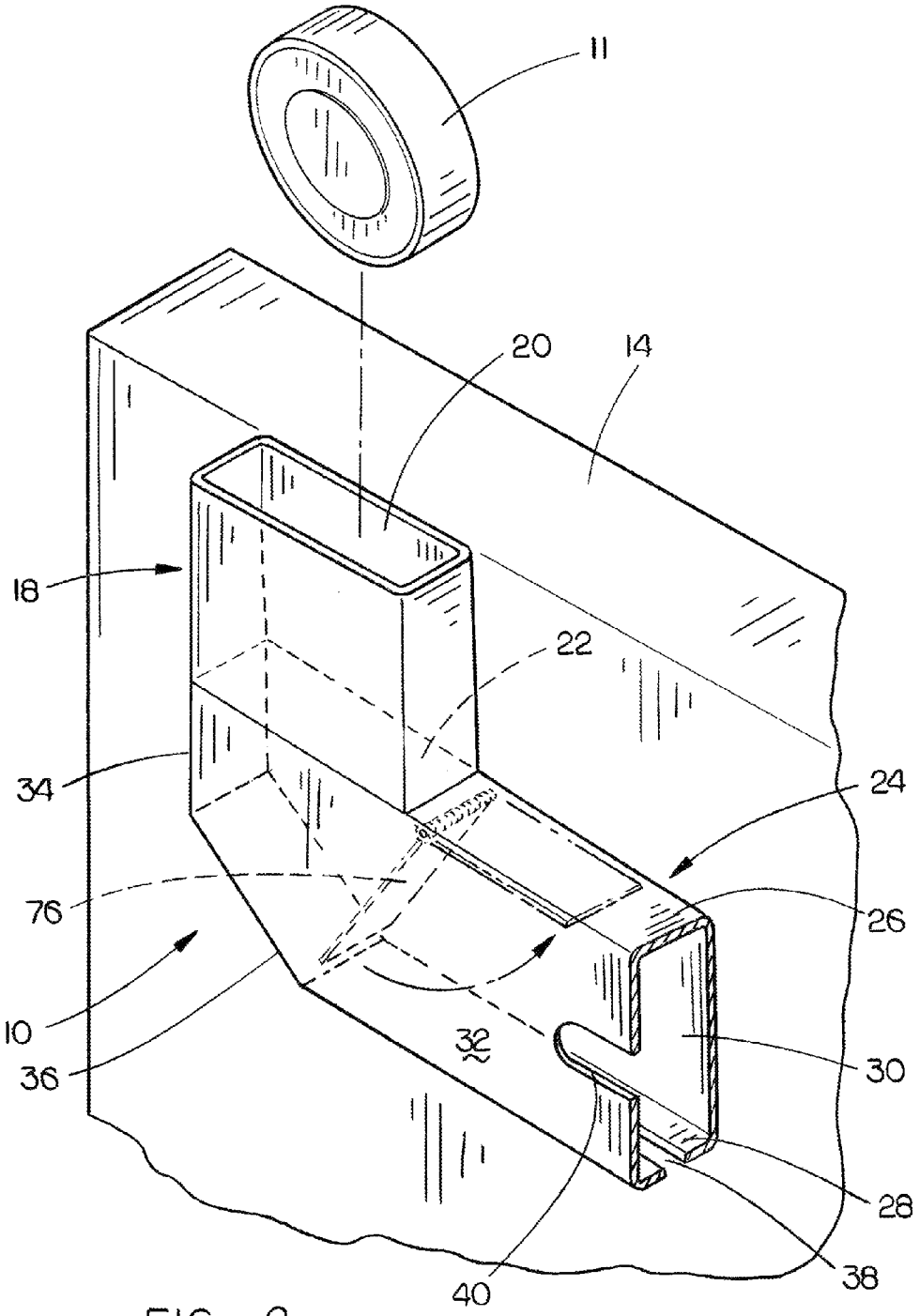
FIG. 2 is a partial perspective view which illustrates the upper portion of the hockey puck locker of this invention.
Figure 3:
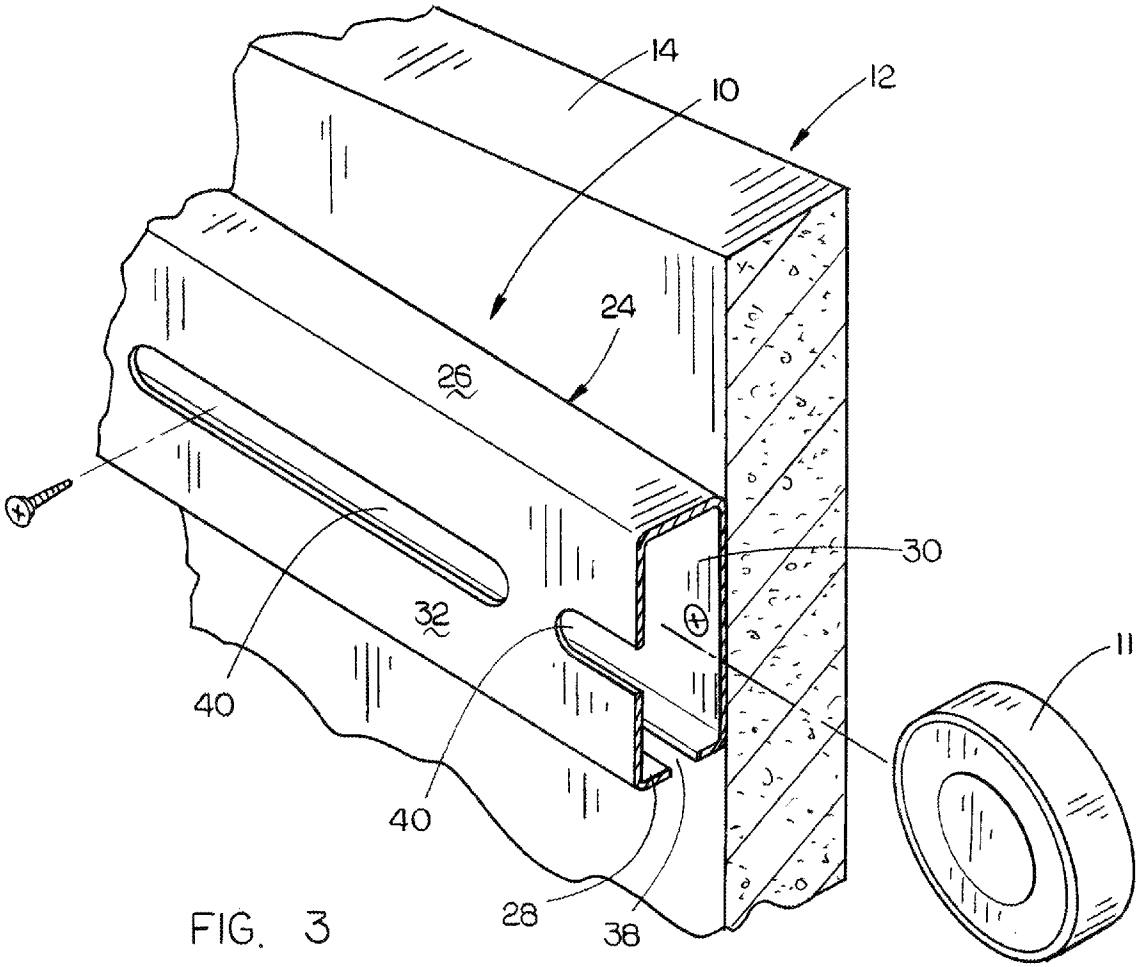
FIG. 3 is a partial perspective view which illustrates a portion of the second rectangular tubular member of this invention mounted on a wall.
Figure 4:
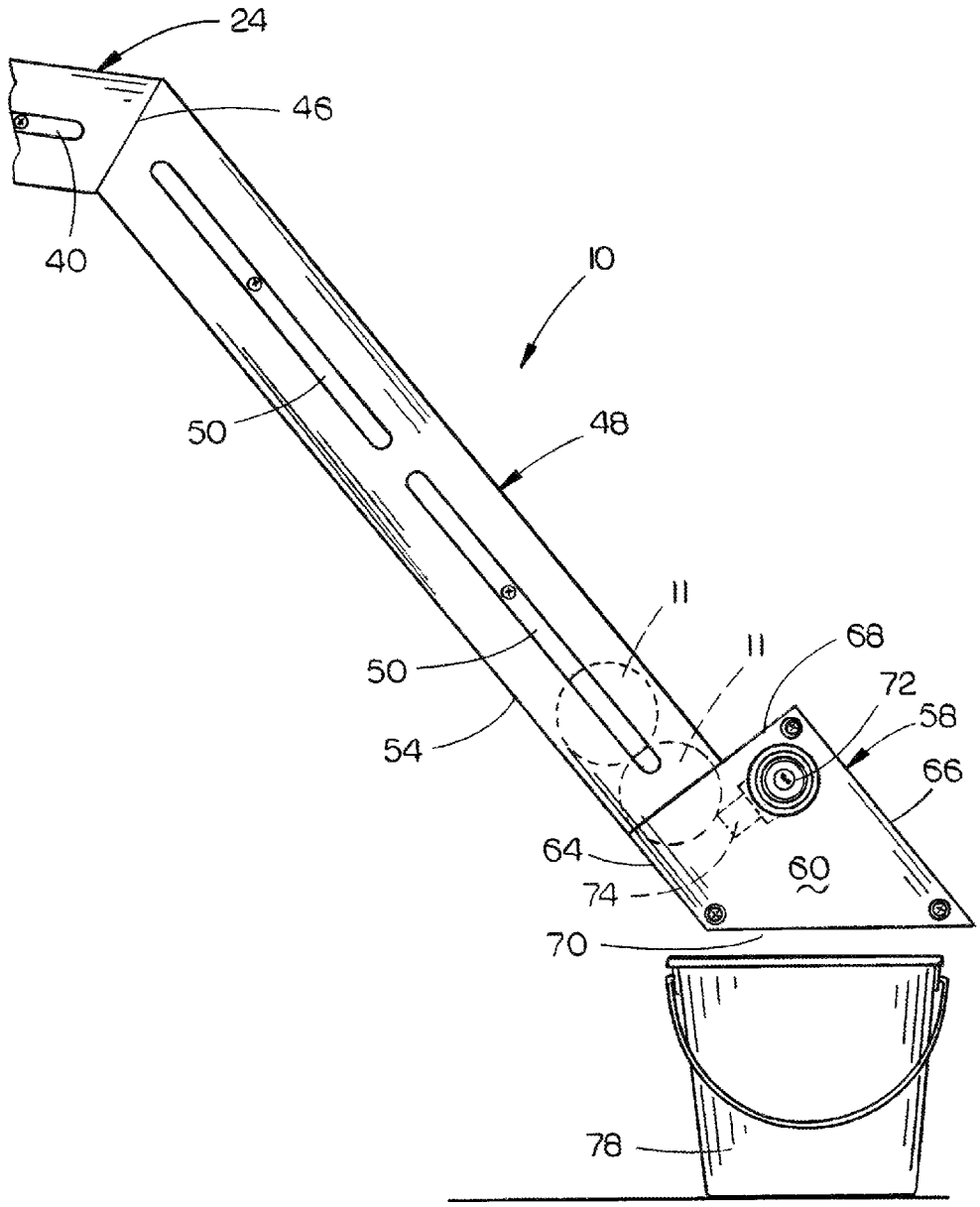
FIG. 4 is a partial side view illustrating the lower portion of the locker of this invention.

The numeral 74 refers to a check flap which is pivotally mounted at 78 to upper wall 26 of tube 24. Check flap 76 is movable between the normally closed position of FIG. 2 to an upper open position also illustrated in FIG. 2. When check flap 76 is in the closed position, a puck rolling downwardly from tube 18 will move the check flap 76 from its closed position to its open position so that the puck may roll downwardly through the tube 24. When pucks 11 are positioned in tube 24 and the check flap 76 is in its closed position, someone cannot reach through the slots 40 and attempt to push a puck upwardly from tube 24 and outwardly through tube 18.

In use, the locker or locker 10 will be mounted on a wall or the outer side of a hockey rink wall 12 by screws or other means. The locker 10 is mounted on the wall 12 so that the open lower end 70 of housing 58 is positioned so that a pail or bucket 76 may be positioned below housing 58 to receive the dispensed pucks. The fact that the tube 48 also extends outwardly away from wall 12 enables the conventional positioned of the pail or bucket 76 below the lower end of the locker. If there is a sufficient clearance between the outer side of the wall 12 and the housing 58, the tube 48 will not have to extend outwardly from wall 12.

Assuming that a hockey team is scheduled to practice, an attendant will lock the dead bolt lock 72 and remove the key from the lock 72. The attendant will then individually drop or feed pucks 11 downwardly into the open upper end 20 of tube 18. The first puck inserted into the tube 18 of locker 10 will roll downwardly through tube 24, through tube 48 and into locker housing 58. The dead bolt 74 prevents the puck 11 from passing through the open lower end 70 of housing 58. The attendant continues to feed pucks 11 into the tube 18 until the tubes 48 and 24 are filled or until the desired number of pucks are in the locker 10. When the practice team is assigned to a designated locker room, the attendant will give the coach of the team the key for a particular locker 10. The coach will then place the pail or bucket 78 beneath the housing 58 and unlock the dead bolt lock 72 which permits the pucks 11 in the locker to fall from the locker 10 into the bucket or pail 78. After practice, the coach of the team will then lock the dead bolt lock 72 and feed the practice pucks 11 into the locker 10. The coach will then remove the key from the lock 72 and return the key to the attendant so that the pucks are readily available for the next practice team.

The slots 38 formed in the lower wall 28 of tube 24 and the slots formed in the lower wall 54 of tube 48 permit the melted ice, if any, on the pucks 11 to drain therefrom. The slots 40 in tube 24 and the slots 52 in tube 48 enable a person to insert a pencil, screw driver, etc. therethrough to free any jam of the pucks 11 therein.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A locker for mounting on the outer side of an upstanding wall of a hockey rink with the locker configured to hold a plurality of flat disc-shaped practice hockey pucks having first and second sides, comprising:

an upstanding first rectangular tubular member including a vertically disposed back wall, a vertically disposed front wall spaced from said back wall, a vertically disposed first side wall, a vertically disposed second side wall, an open upper end and an open lower end;

each of said walls of said first rectangular tubular member having inner and outer sides and upper and lower ends;

said first rectangular tubular member having an inside diameter of approximately one and one-quarter inches by three and three-quarter inches;

said outer side of said back wall of said first rectangular tubular member being positioned adjacent the outer side wall of the hockey rink whereby said first rectangular tubular member is parallel to the outer side of the wall of the hockey rink;

said front wall, said back wall, said first side wall and said second side wall of said first rectangular tubular member being sufficiently spaced-apart to permit individual flat disc-shaped practice hockey pucks to successively pass downwardly through said open upper end of said first rectangular tubular member and downwardly through said first rectangular tubular member one after the other;

a second rectangular tubular member including a vertically disposed back wall, a vertically disposed front wall, an upper wall, a lower wall, an open upper end and an open lower end;

said open upper end of said second rectangular tubular member being in communication with said open lower end of said first rectangular tubular member;

said second rectangular tubular member extending downwardly and laterally from said open lower end of said first rectangular tubular member in the same vertical plane as said first rectangular tubular member;

said second rectangular tubular member being positioned adjacent the outer side of the upstanding wall of the hockey rink;

said back wall of said second rectangular tubular member being secured to the outer side of the upstanding wall of the hockey rink;

said second rectangular tubular member being positioned adjacent the upstanding wall of the hockey rink whereby said second rectangular tubular member is parallel to the upstanding wall of the hockey rink;

said back wall, said front wall, said upper wall and said lower wall of said second rectangular tubular member being sufficiently spaced-apart to permit flat disc-shaped practice hockey pucks to successively pass downwardly through said second rectangular tubular member one after the other;

a normally closed check flap pivotally movably mounted in said upper end of said second rectangular tubular member which is configured to permit practice hockey pucks to move downwardly through said second rectangular tubular member but which prevents practice hockey pucks from being moved upwardly from said upper end of said rectangular tubular member into said first rectangular tubular member;

said bottom wall of said second rectangular tubular member having a plurality of drainage slots formed therein;

said second rectangular tubular member having an inside diameter of approximately one and one-quarter inches by three and three-quarter inches;

a third rectangular tubular member including a back wall, a front wall, an upper wall, a lower wall, an open upper end, and an open lower end;

each of said walls of said third rectangular tubular member having inner and outer sides;

said open upper end of said third rectangular tubular member being secured to said open lower end of said second rectangular tubular member;

said open upper end of said third rectangular tubular member being configured to receive practice hockey pucks from said lower open end of said second rectangular tubular member;

said back wall, said front wall, said upper wall and said lower wall of said third rectangular tubular member having an inside diameter of approximately one and one-quarter inches by three and three-quarter inches to permit the flat disc-shaped practice hockey pucks to successively pass downwardly through said third rectangular tubular member one after the other;

said third rectangular tubular member extending downwardly from said second rectangular tubular member at an angle with respect thereto;

said third rectangular tubular member also extending away from the outer side of the wall of the hockey rink whereby said open lower end thereof is spaced from the outer side of the wall of the hockey rink;

a practice hockey puck discharge housing having an open upper intake end and an open lower discharge end;

said open upper intake end of said practice hockey puck discharge housing being in communication with said lower open end of said third rectangular tubular member;

said open upper intake end of said practice hockey puck discharge housing being configured to successively receive flat disc-shaped practice hockey pucks from said lower open end of said third rectangular tubular member one after the other;

said practice hockey puck discharge housing being configured to temporarily store a plurality of practice pucks therein;

said open lower discharge end of said practice hockey puck discharge housing being spaced from the outer side of the wall of the hockey rink whereby a puck container may be positioned beneath said open lower end of said practice hockey puck discharge housing;

a key operated dead bolt lock in said practice hockey puck discharge housing including a slidable dead bolt which is movable between locked and unlocked positions;

said slidable dead bolt, when in said locked position, preventing the passage of practice hockey pucks from said open lower discharge end of said practice hockey puck discharge housing; and said slidable dead bolt, when in said unlocked position, permitting the passage of all the practice hockey pucks in said first rectangular tube member, said second rectangular tubular member, said third rectangular tubular member and said practice hockey puck discharge housing from said open lower discharge end of said practice hockey puck discharge housing into the puck container solely by gravity.

2. A locker for mounting on an upstanding wall member with the locker configured to hold a plurality of flat disc-shaped practice hockey pucks having first and second sides, comprising:

an upstanding first rectangular tubular member including a vertically disposed back wall, a vertically disposed front wall spaced from said back wall, a vertically disposed first side wall, a vertically disposed second side wall, an open upper end and an open lower end;

each of said walls of said first rectangular tubular member having inner and outer sides and upper and lower ends;

said first rectangular tubular member having an inside diameter of approximately one and one-quarter inches by three and three-quarter inches;

said outer side of said back wall of said first rectangular tubular member being positioned adjacent the upstanding wall member whereby said first rectangular tubular member is parallel to the upstanding wall member;

said front wall, said back wall, said first side wall and said second side wall of said first rectangular tubular member being sufficiently spaced-apart to permit individual flat disc-shaped practice hockey pucks to successively pass downwardly through said open upper end of said first rectangular tubular member and downwardly through said first rectangular tubular member one after the other;

a second rectangular tubular member including a vertically disposed back wall, a vertically disposed front wall, an upper wall, a lower wall, an open upper end and an open lower end;

said open upper end of said second rectangular tubular member being in communication with said open lower end of said first rectangular tubular member;

said second rectangular tubular member extending downwardly and laterally from said open lower end of said first rectangular tubular member in the same vertical plane as said first rectangular tubular member;

said second rectangular tubular member being positioned adjacent the upstanding wall member;

said back wall of said second rectangular tubular member being secured to the upstanding wall member;

said second rectangular tubular member being positioned adjacent the upstanding wall member whereby said second rectangular tubular member is parallel to the upstanding wall member;

said back wall, said front wall, said upper wall and said lower wall of said second rectangular tubular member being sufficiently spaced-apart to permit flat disc-shaped practice hockey pucks to successively pass downwardly through said second rectangular tubular member one after the other;

a normally closed check flap pivotally movably mounted in said upper end of said second rectangular tubular member which is configured to permit practice hockey pucks to move downwardly through said second rectangular tubular member but which prevents practice hockey pucks from being moved upwardly from said upper end of said rectangular tubular member into said first rectangular tubular member;

said second rectangular tubular member having an inside diameter of approximately one and one-quarter inches by three and three-quarter inches;

a third rectangular tubular member including a back wall, a front wall, an upper wall, a lower wall, an open upper end, and an open lower end;

each of said walls of said third rectangular tubular member having inner and outer sides;

said open upper end of said third rectangular tubular member being secured to said open lower end of said second rectangular tubular member;

said open upper end of said third rectangular tubular member being configured to receive practice hockey pucks from said lower open end of said second rectangular tubular member;

said back wall, said front wall, said upper wall and said lower wall of said third rectangular tubular member having an inside diameter of approximately one and one-quarter inches by three and three-quarter inches to permit the flat disc-shaped practice hockey pucks to successively pass downwardly through said third rectangular tubular member one after the other;

said third rectangular tubular member extending downwardly from said second rectangular tubular member at an angle with respect thereto;

said third rectangular tubular member also extending away from the outer side of the upstanding wall whereby said open lower end thereof is spaced from the upstanding wall;

a practice hockey puck discharge housing having an open upper intake end and an open lower discharge end;

said open upper intake end of said practice hockey puck discharge housing being in communication with said lower open end of said third rectangular tubular member;

said open upper intake end of said practice hockey puck discharge housing being configured to successively receive flat disc-shaped practice hockey pucks from said lower open end of said third rectangular tubular member one after the other;

said practice hockey puck discharge housing being configured to temporarily store a plurality of practice pucks therein;

said open lower discharge end of said practice hockey puck discharge housing being spaced from the upstanding wall whereby a puck container may be positioned beneath said open lower end of said practice hockey puck discharge housing;

a key operated dead bolt lock in said practice hockey puck discharge housing including a slidable dead bolt which is movable between locked and unlocked positions;

said slidable dead bolt, when in said locked position, preventing the passage of practice hockey pucks from said open lower discharge end of said practice hockey puck discharge housing; and said slidable dead bolt, when in said unlocked position, permitting the passage of all the practice hockey pucks in said first rectangular tube member, said second rectangular tubular member, said third rectangular tubular member and said practice hockey puck discharge housing from said open lower discharge end of said practice hockey puck discharge housing into the puck container solely by gravity.

* * * * *